United States Patent [19]

Tanaka et al.

[11] 4,254,560

[45] Mar. 10, 1981

[54] METHOD OF DRYING BROWN COAL

[75] Inventors: Minoru Tanaka; Ryoji Harihara, both of Kitakyushu, Japan

[73] Assignees: Electric Power Development Co., Inc.; Nagata Seisakusho Co., Ltd., both of Japan

[21] Appl. No.: 34,057

[22] Filed: Apr. 27, 1979

[30] Foreign Application Priority Data

Oct. 20, 1977 [JP] Japan ..... 52-126244

[51] Int. Cl.[3] ..... F26B 7/00

[52] U.S. Cl. ..... 34/12; 34/17

[58] Field of Search ..... 34/12, 17, 60

[56] References Cited

U.S. PATENT DOCUMENTS 3,482,327 12/1969 Dutcher et al. ..... 34/12

3,992,784 11/1976 Verschvor et al. ..... 34/12

*Primary Examiner*—John J. Camby

[57] ABSTRACT

A method of drying brown coal in which the brown coal is pelletized before the drying into pellets of 2 to 5 mm dia. by a wet pelletizing process making use of the water contained by the coal itself as the binder. The brown coal in the form of dried pellets has a larger bulk density than the brown coal in the form of fine powders which are obtained when the brown coal after the exploitation is directly dried, and, therefore, contributes to the reduction of the transportation cost. In addition, the dried brown coal in the form of pellets can be handled and transported in quite an easy manner, as compared with the case of powdered brown coal. Further, thanks to the improved ventilation afforded by the gaps between the pellets, the possibility or chance of undesirable spontaneous combustion is greatly reduced.

6 Claims, 1 Drawing Figure

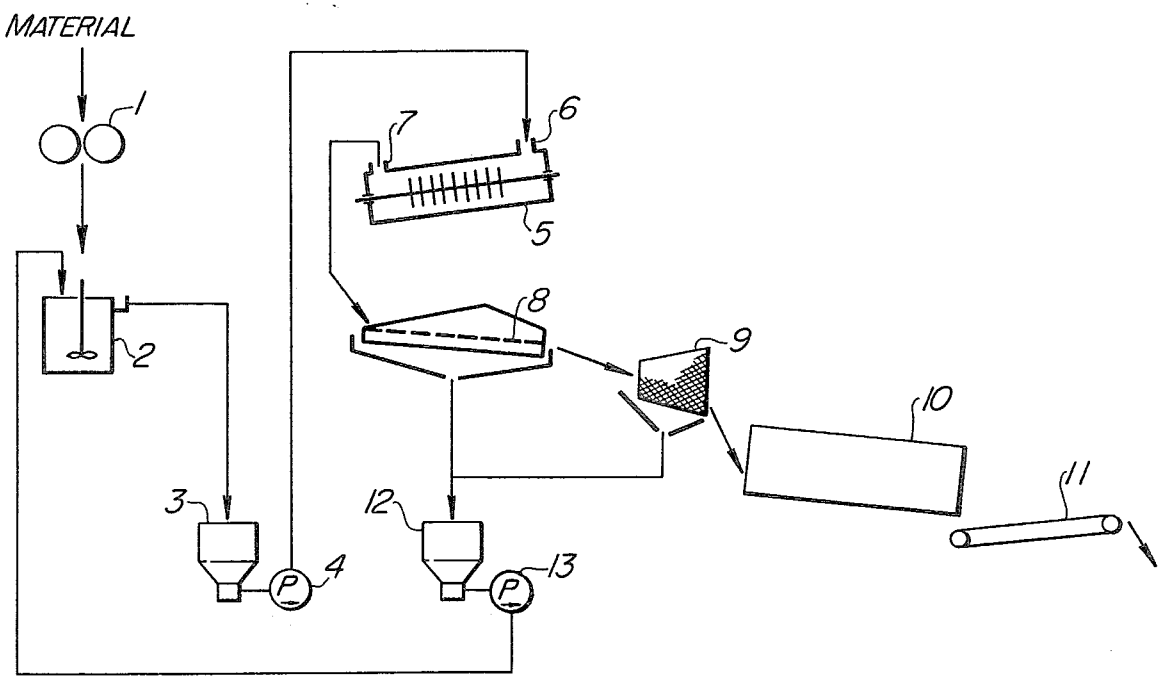
MATERIAL
1
2
3
4
5
6
7
8
9
10
11
12
13

METHOD OF DRYING BROWN COAL

BACKGROUND OF THE INVENTION

The present invention relates to a method of drying brown coal and, more particularly, to a method of drying brown coal which can obviate various problems in handling and transportation of dried brown coal.

Nowadays, most of energy consumed in the civilized society owes to petroleum. In the 1960's, an additional petroleum deposite of 5 billion Kl as a mean has been confirmed every year. This petroleum deposite additionally confirmed is said to amount to 35 years' supply of petroleum, when calculated on the basis of present rate of yield per year. However, from now on, the new exploitation of the petroleum will be concentrated to areas where the natural conditions are extremely severe. These severe conditions will render the discovery of new petroleum deposits increasingly difficult with regard to both the aspect of exploitation technique and fund.

Even if an additional discovery of petroleum deposite of 5 billion Kl per year is possible in the future, the amount of petroleum reserves will be reduced to 20 years' supply 13 years after now and to 5 years' supply 28 years after now. It is clear that the world will face a limit to the exploitation of petroleum technically and financially, within several decades. Thus, it will become extremely difficult to obtain petroleum in an amount necessary for meeting the energy demand, particularly for those countries having little oil resources under their grounds.

Under these circumstances, there is an increasing demand for new energy techniques as measures for avoiding future energy crisis.

One of these measures is to exploit and use brown coal as a new energy source. The utilization of the brown coal has not been yet developed in spite of its low price and abundance. It is estimated that there is a deposite of wood coal and brown coal of 2 trillion tons over the world. In fact, a deposite of 2700 billion tons of wood coal and brown coal, which amounts to 1350 billion tins in coal base, has been confirmed, 39%, 34% and 18% of which belong to U.S. Sr, European countries and Australia.

The brown coal burried under the territory of, for example, Australia contains 66.7 to 50% of water, 0.7 to 4.9% of ash content, 16.8 to 24.8% of volatile matter and 15.8% to 23.5% of fixed carbon.

One of the most serious defects of the brown coal is the large water content. The transportation cost will be raised unless the water content is suitably removed. It is therefore essential to dry and dehydrate the brown coal when the brown coal is used for industrial purposes.

In most cases, the natural brown coal exists in the form of extremely fine particles of a particle size of about 40$\mu$ or smaller, bonded to one another. Therefore, when the natural brown coal is dried and dehydrated, these fine particles are freed from one another to take the form of powders, incurring various problems such as environmental pollution by the scattering of fine particles, difficulty in handling and so forth. In addition, the bulk density of the brown coal in the dried state is as low as about 0.3, which considerably raises the cost of transportation. Further, there is a danger of spontaneous combustion of the powders of brown coal during transportation and storage.

SUMMARY OF THE INVENTION

It is therefore a major object of the invention to provide a method of drying brown coal, which can obviate various problems as stated above.

To this end, according to the invention, there is provided a method of drying brown coal, characterized by comprising the steps of pelletizing the brown coal into pellets by a wet or liquid phase pelletizing process, and then drying the pellets.

The wet or liquid phase pelletizing process is a process to obtain pellets directly from the suspension, through stirring and mixing any constituent of the dispersed phase of the suspension by a suitable method to effect a separation of the dispersed phase and dispersion medium of the suspension from each other allowing a preferential pelletizing of the dispersed phase.

It is advantageous that, since the brown coal processed by a method according to the present invention has a hydrophilic nature, it is possible to use water as the bridge forming substance, i.e. the binder. In comparison, a further type of brown coal has a hydrophobic nature and is not capable of uniting with or absorbing water, thereby eliminating water as a suitable binder. In addition, because the brown coal itself immediately after the exploitation is rich in water, the pelletizing can be achieved without using any specific additive other than water, contributing greatly to the reduction of the cost.

An organic liquid is used as the dispersion medium, in case where the water is used as the binder. More specifically, mineral oils such as heavy oil, kerosene and the like can suitably be used as the dispersion medium.

The above and other objects, as well as advantageous features of the invention will become more clear from the following description of the preferred embodiment taken in conjunction with the accompanying drawings.

BRIEF DESCRIPTION OF THE DRAWINGS

The attached sole FIGURE shows a flow sheet of a method of the invention for drying brown coal.

DESCRIPTION OF THE PREFERRED EMBODIMENTS

According to the preferred embodiment of the invention, the brown coal (dry), a dispersion medium and a binder are mixed at a ratio of 1:4:2 and are vigorously stirred in a stirring chamber for several minutes. As a result, the brown coal is pelletized into pellets of about 5 to 2 mm dia., through the action of the water as the binder. These pellets can easily be separated from the dispersion medium by means of a screen.

The pellets of 5 to 2 mm dia. thus obtained are then dried by a drying apparatus. Since the pellets have considerable weights, they are never scattered as powders or dusts, after the drying. In addition, these dried pellets can be handled and transported at a low cost by a conveyor belt or the like, without employing any specific transportation apparatus.

The pellets of brown coal after the drying exhibit a sufficiently high hardness and, therefore, almost no crushing of the pellets take place during the handling thereof. Also, the bulk density of the brown coal in the form of dried pellets is about 1.4 to 1.7 times as large that of the brown coal in the form of powders obtained when the exploited brown coal is directly dried, and reduces the transportation cost correspondingly. In addition, the gaps in the brown coal in the form of accumulation of pellets of 5 to 2 mm dia. provide good ventilation passages and suppresses the natural temperature rise, so that the possibility or chance of the spontaneous combustion is greatly reduced.

The accompanying drawings show an example of the flow sheet of a process for drying the brown coal in accordance with the method of the invention.

The material coal is crushed by a crusher 1 and is then fed into a preparation chamber 2 together with a mineral oil as a dispersion medium. The material and the mineral oil are then mixed, stirred and crushed in the preparation chamber 2. The admixture liquid of the brown coal and the mineral oil is then fed into a wet or liquid phase type pelletizing machine 5, via a feed pump sump 3, feed pump 4 and an inlet port 6. The admixture liquid fed into the pelletizing machine is then vigorously stirred and moved toward an overflow 7, during which the admixture is changed into pellets of brown coal of about 5 to 2 mm dia. The mixture of the pellets and the mineral oil is then split from the overflow 7 of the pelletizing machine, with the pellets then separated from each other by means of a screen 8. The pellets of the brown coal arrested by the screen 8 are then delivered to a centrifugal oil separator 9 adapted to completely remove the oil from the pellets. After the removal of the oil, the pellets are dried by a drying apparatus 10, and are conveyed by a conveyor 11 to a place where the pellets ae to be stored. Meanwhile, the mineral oil separated in the screen 8 and the centrifugal oil separator 9 is collected and fed back to the preparation chamber 2, through oil recirculation pump sump 12 and an oil recirculation pump 12, for a repeated use as the dispersion medium.

Although the invention has been described through its preferred form, it is to be noted that the described embodiment is not exclusive, and various changes and modifications may be imparted thereto without departing from the scope of the invention which is delimited solely by the appended claims.

What is claimed is:

1. A method of manufacturing dry pellets of a hydrophilic brown coal material of the type naturally containing a quantity of water following exploitation, said method comprising the following steps:

introducing a quantity of crushed hydrophilic type brown coal material into a preparation chamber, introducing a quantity of non-aqueous liquid dispersion medium into said preparation chamber;

mixing said crushed hydrophilic brown coal and said liquid dispersion medium to form a non-aqueous liquid admixture including hydrophilic brown coal particles dispersed throughout said non-aqueous liquid dispersion medium;

directly introducing said non-aqueous liquid admixture into a liquid phase pelletizing machine;

vigorously stirring and mixing only said non-aqueous liquid admixture, whereby said naturally contained water present within said hydrophilic brown coal particles at the time of exploitation is released and serves to automatically bind said coal particles into pellets, without additional binder being provided;

drying said resulting pellets of coal.

2. A method according to claim 1, including a step of initially crushing said hydrophilic coal material prior to mixing said coal material with said non-aqueous liquid.

3. A method according to claim 1, including the additional step of separating said non-aqueous liquid dispersion medium from said pellets of hydrophilic coal prior to drying of said pellets.

4. A method according to claim 3, including the additional step of collecting said non-aqueous liquid dispersion medium after separation from said pellets, and further mixing said collected non-aqueous liquid with an additional quantity of said hydrophilic coal particles having a quantity of naturally contained water.

5. A method according to claim 1, including the further step of preparing a liquid admixture including a quantity of said coal particles having naturally contained water dispersed throughout an organic liquid dispersion medium.

6. A method according to claim 5, including the step of dispersing said quantity of hydrophilic coal particles throughout a mineral oil dispersion medium.

* * * * *